US006187116B1

(12) United States Patent
Gilles

(10) Patent No.: US 6,187,116 B1
(45) Date of Patent: Feb. 13, 2001

(54) ALLOY AND PROCESS FOR GALVANIZING STEEL

(75) Inventor: Michael Gilles, Geel (BE)

(73) Assignee: N.V. Union Minere S.A., Brussels (BE)

( * ) Notice: Under 35 U.S.C. 154(b), the term of this patent shall be extended for 0 days.

(21) Appl. No.: 09/443,290

(22) Filed: Nov. 19, 1999

Related U.S. Application Data

(63) Continuation of application No. PCT/BE98/00075, filed on May 25, 1998.

(30) Foreign Application Priority Data

May 23, 1997 (EP) ..... 97201536

(51) Int. Cl.[7] ..... C22C 18/00; C23C 2/06

(52) U.S. Cl. ..... 148/441; 148/242; 148/533; 420/519; 420/520; 420/524; 428/629; 428/659; 427/383.7; 427/433; 427/455

(58) Field of Search ..... 148/441, 242, 148/533; 420/524, 519, 520; 428/629, 659; 427/383.7, 433, 455, 456

(56) References Cited

U.S. PATENT DOCUMENTS 5,049,453 * 9/1991 Suemitsu et al. ..... 428/629

FOREIGN PATENT DOCUMENTS

97/31137 8/1997 (WO) .

OTHER PUBLICATIONS

*Chemical Abstracts,* vol. 124, No. 12, Mar. 18, 1996 (Abstract No. 150969), JP7296813.

* cited by examiner

*Primary Examiner*—Sikyin Ip
(74) *Attorney, Agent, or Firm*—Antonelli, Terry, Stout & Kraus, LLP.

(57) ABSTRACT

This disclosure relates to an Sn-containing and/or Bi-containing zinc alloy for hot galvanizing steel, more particularly for component galvanizing. The alloy is composed of 1 to 5% by weight of Sn+Bi, 0 to saturation of Pb, 0.025 to 0.200% by weight of at least one of Ni, Cr or Mn, 0 to 0.030% by weight of at least one of Al, Ca and Mg, the remainder being zinc and unavoidable impurities.

5 Claims, No Drawings

ALLOY AND PROCESS FOR GALVANIZING STEEL

RELATED APPLICATION

This application is a continuation of copending international patent application PCT/BE98/00075, filed May 25, 1998.

This invention relates to an Sn-containing and Bi-containing zinc alloy for hot-galvanizing steel, more particularly for component galvanizing.

BACKGROUND

The effect of adding only Sn and adding Sn and Ni to a zinc bath is discussed in EP 96200465.1. These additions ensure a delay in the Zn/Fe reaction in the case of reactive steels such as Si-containing and/or P-containing steel. Unduly thick zinc layers are thus avoided. A relatively high Sn concentration in the bath is, however, necessary and makes the process economically less attractive. In addition, there is the danger at fairly high Sn concentrations of the formation of a heterogeneous galvanization layer containing Sn precipitates.

The effect of V, Cr, Ni and Mn on the Zn/Fe reaction in a galvanization bath not containing Sn is described in J. J. Sebisty et al., Proceedings of the 8th International Conference on Hot-Dip Galvanizing, London, 1967. These alloys are, however, insufficiently effective for the correct galvanization of P-containing steel or of steel having high Si contents.

DETAILED DESCRIPTION OF INVENTION

The object of this-invention is to limit the concentration in the bath because Sn is a fairly expensive metal, while galvanization is nevertheless correct for P-containing steel and for steel having high Si contents. For this purpose, use is made of a zinc alloy containing 1 to 5% by weight of Sn and Bi, 0 to saturation of Pb, 0.025 to 0.200% by weight of at least one of Ni, Cr or Mn, 0 to 0.030% by weight of at least one of Al, Ca and Mg; the remainder is zinc and unavoidable impurities.

Depending on the market situation, it is therefore possible to replace Sn partially by Bi. Pb can be added up to saturation. Pb is cheaper than Sn and Bi, but is less effective and is less attractive from the ecological standpoint.

As a result of adding Sn and Bi to the zinc bath, the wetting of the steel to be galvanized is improved and the melting point is lowered. This has a plurality of advantages, such as, for example, the possibility of galvanizing at lower temperature, resulting in lower energy consumption and less corrosion of the zinc bath. Short dip times are also possible, as well as the possibility of applying extra-thin zinc layers.

EXAMPLES

These alloys have been tested on various normal types of steel but also on reactive types of steel containing different P and Si concentrations. The table below shows the composition of the types of steel tested.

| Type of steel | X | M | E | R | Y |
|---|---|---|---|---|---|
| % by wt Si | 0.010 | 0.092 | 0.177 | 0.018 | 0.075 |
| % by wt P | 0.015 | 0.014 | 0.020 | 0.069 | 0.017 |

The following table shows the thickness of the galvanization layer for different bath compositions for a dip time of 5 minutes.

| Composition of the bath in % by wt | | | | | | Temp. | Layer thickness |
|---|---|---|---|---|---|---|---|
| Sn | Bi | Pb | Ni | Mn | Cr | ° C. | μm |
| 2.5 | | | 0.050 | | | 435 | <80 |
| 2.5 | | | 0.060 | | | 450 | <80 |
| 2.5 | | | 0.029 | 0.027 | | 450 | <80 |
| 2.5 | | | | 0.055 | | 450 | <80 |
| 2.5 | | | | 0.100 | | 450 | <100 |
| 2.5 | | | | | 0.030 | 450 | <100 |
| 2.5 | | | | | 0.055 | 450 | <80 |
| 1.9 | 0.5 | | 0.050 | | | 450 | <80 |
| 1.5 | 1.0 | | 0.055 | | | 450 | <80 |
| 0.9 | 1.5 | | 0.053 | | | 450 | <80 |
| 2.5 | | 0.3 | | | | 450 | up to 250 |
| | | 0.3 | | | | 450 | up to 400 |

What is claimed is:

1. A bath for hot-dip galvanizing consisting of an Sn- and Bi-containing zinc alloy, consisting of 1 to 5% by weight of Sn plus Bi, 0 to saturation of Pb, 0.025 to 0.200% by weight of at least one of Ni, Cr or Mn, 0 to 0.030% by weight of at least one of Al, Ca and Mg, the remainder being zinc and unavoidable impurities.

2. A bath according to claim 1, containing 0.025 to 0.100% by weight of Cr.

3. A bath according to claim 1, containing 0.025 to 0.200% by weight of Mn.

4. A bath according to claim 1, containing 0.025 to 0.060% by weight of Ni.

5. A process for component galvanizing of steel products which may contain Si and/or P, comprising the steps of:

providing a molten bath of an Sn- and Bi-containing zinc alloy consisting of 1 to 5% by weight of Sn plus Bi, 0 to saturation of Pb, 0.025 to 0.200% by weight of at least one of Ni, Cr or Mn, 0 to 0.030% by weight of at least one of Al, Ca and Mg, the remainder being zinc and unavoidable impurities; and dipping a steel product in said molten bath to galvanize said product.

* * * * *